US006247590B1

(12) United States Patent
Baker

(10) Patent No.: US 6,247,590 B1
(45) Date of Patent: Jun. 19, 2001

(54) THERMOFORMED SELECTIVELY ACCESSED MULTI-CHAMBERED PACKAGING

(75) Inventor: Jay J. Baker, Mayville, NY (US)

(73) Assignee: Jamestown Plastics, Inc., Brocton, NY (US)

( * ) Notice: Subject to any disclaimer, the term of this patent is extended or adjusted under 35 U.S.C. 154(b) by 0 days.

(21) Appl. No.: 09/344,610

(22) Filed: Jun. 25, 1999

(51) Int. Cl.[7] ..... B65D 85/68

(52) U.S. Cl. ..... 206/335; 206/467; 220/524; 220/557

(58) Field of Search ..... 206/301, 335, 206/364, 461, 464, 467–471, 806; 220/523, 524, 796, 557

(56) References Cited

U.S. PATENT DOCUMENTS

| | | | | |
|---|---|---|---|---|
| 1,396,434 | * | 11/1921 | Horton | 220/524 |
| 3,315,718 | | 4/1967 | Berman . | |
| 3,979,020 | | 9/1976 | Braber et al. . | |
| 3,991,294 | | 11/1976 | Evans . | |
| 4,034,885 | * | 7/1977 | Hunckler et al. | 220/524 |
| 4,252,585 | | 2/1981 | Raabe et al. . | |
| 4,253,572 | * | 3/1981 | Halbich | 220/524 |
| 4,289,265 | | 9/1981 | Ellerbrock . | |
| 4,451,721 | | 5/1984 | Nemeskeri . | |
| 4,592,493 | | 6/1986 | Smith . | |
| 4,658,422 | * | 4/1987 | Sparks | 220/524 |
| 4,701,967 | | 10/1987 | Strobel . | |
| 4,819,411 | | 4/1989 | Konzal et al. . | |
| 4,854,450 | * | 8/1989 | Fisher | 206/461 |
| 4,900,389 | | 2/1990 | Schnell et al. . | |
| 4,973,298 | | 11/1990 | Ferguson . | |
| 5,027,947 | * | 7/1991 | Reighart | 206/335 |
| 5,038,936 | | 8/1991 | Borst . | |
| 5,066,290 | | 11/1991 | Measells et al. . | |
| 5,143,215 | | 9/1992 | Hartley et al. . | |
| 5,160,396 | | 11/1992 | Jensen et al. . | |
| 5,316,547 | | 5/1994 | Gildersleeve . | |
| 5,345,705 | | 9/1994 | Lawrence . | |
| 5,361,896 | * | 11/1994 | Yang | 206/461 |
| 5,379,896 | * | 1/1995 | Snow et al. | 206/470 |
| 5,466,322 | | 11/1995 | Munsch . | |
| 5,697,514 | | 12/1997 | Hekal . | |
| 5,775,516 | * | 7/1998 | McCumber et al. | 206/470 |
| 5,803,260 | | 9/1998 | Tilton . | |
| 5,863,414 | | 1/1999 | Tilton . | |
| 5,878,891 | | 3/1999 | Bentley, II . | |
| 5,899,334 | * | 5/1999 | Domerchie et al. | 206/470 |

* cited by examiner

*Primary Examiner*—Paul T. Sewell
*Assistant Examiner*—Luan K. Bui
(74) *Attorney, Agent, or Firm*—Alston & Bird LLP

(57) ABSTRACT

Packaging made of inexpensive thermoformed plastic is described. The packaging includes a base and cover defining a plurality of chambers. The cover includes a plurality of flaps, each flap corresponding to a chamber. The flaps can be manipulated independently of one another to provide selective access to a desired chamber with opening other chambers. The invention can be applied to create through thermoforming packaging of many different shapes and sizes.

5 Claims, 3 Drawing Sheets

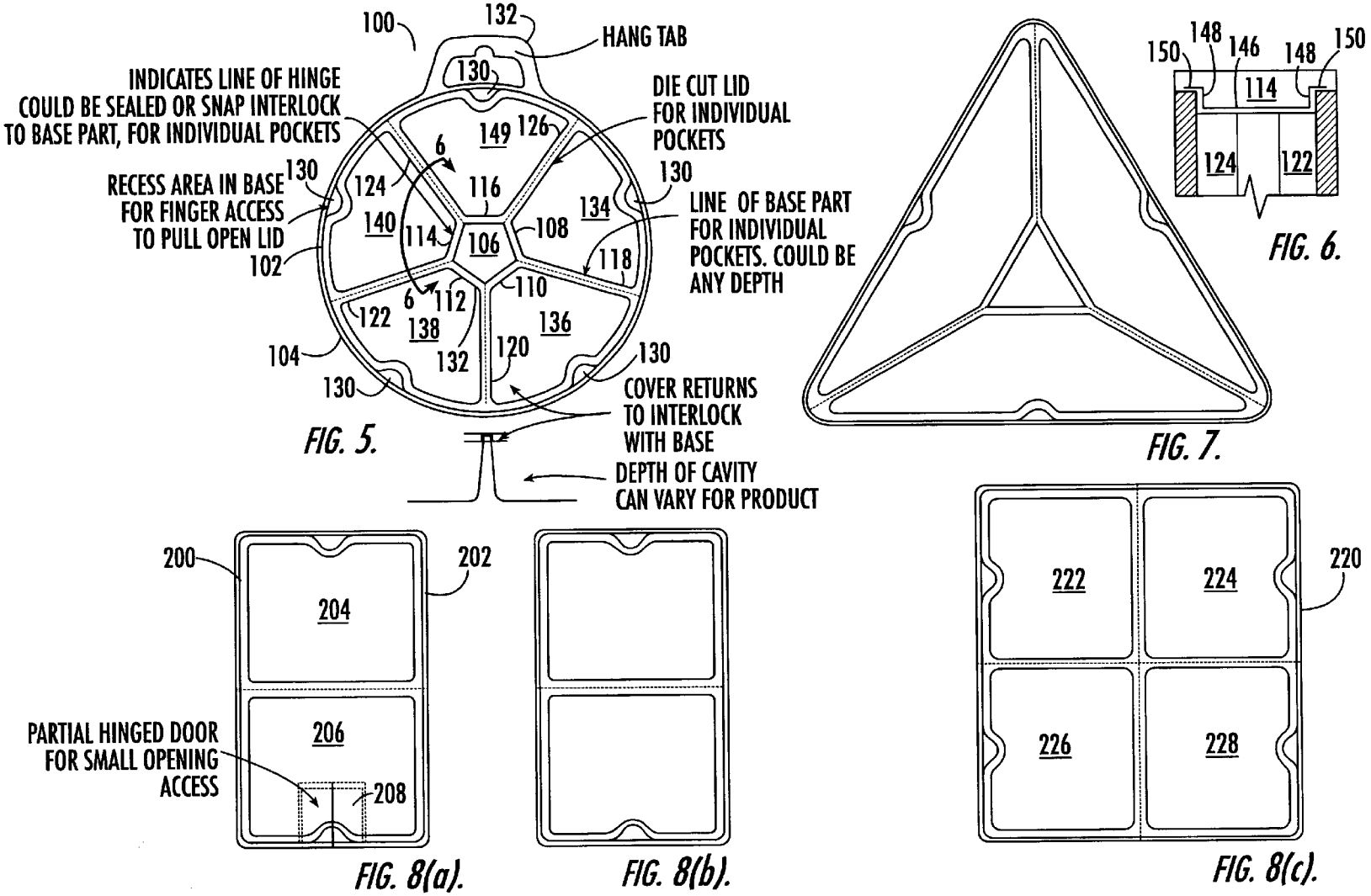
150
148
146
114
122
124
148
150
FIG. 6.
FIG. 7.
220
224
228
222
226
FIG. 8(c).
HANG TAB
DIE CUT LID FOR INDIVIDUAL POCKETS
LINE OF BASE PART FOR INDIVIDUAL POCKETS. COULD BE ANY DEPTH
COVER RETURNS TO INTERLOCK WITH BASE
DEPTH OF CAVITY CAN VARY FOR PRODUCT
132
130
149
126
116
106
108
134
118
110
136
120
130
132
112
138
114
6
6
124
140
122
130
130
100
INDICATES LINE OF HINGE COULD BE SEALED OR SNAP INTERLOCK TO BASE PART, FOR INDIVIDUAL POCKETS
RECESS AREA IN BASE FOR FINGER ACCESS TO PULL OPEN LID
102
104
FIG. 5.
FIG. 8(b).
202
204
206
208
200
PARTIAL HINGED DOOR FOR SMALL OPENING ACCESS
FIG. 8(a).

THERMOFORMED SELECTIVELY ACCESSED MULTI-CHAMBERED PACKAGING

BACKGROUND OF THE INVENTION

The invention relates to storage and display of multiple categories of items in low cost packaging, and more specifically to low cost packaging made of thermoformed plastics having selectively and independently opening and closing doors to access multiple categories of items in separate chambers within the packaging.

DESCRIPTION OF PRIOR ART

Plastic packaging is ubiquitous. All types of plastics forming techniques are used to create plastic packaging including blow-mold, rotational mold and thermoforming. Each of these techniques has its own strengths and weaknesses. For example, more expensive injection and blow molding techniques have been used to create sturdy storage box style packaging while less expensive thermoforming has been used traditionally with single use blister style packaging for smaller, less expensive goods. However, a class of less expensive goods exists where innovative packaging could provide a significant competitive advantage. This class can generally be described as including groups of similar or complementary, inexpensive and small items sold as a single unit. These items include hardware, (e.g., screws, nails, wall-banging kits and nuts and bolts kits), craft items (e.g., beads, wire, pipe cleaners and sequins), automotive items (e.g., wiper blade and required hardware) and self-assembly items (e.g., toys and furniture).

For example, many items, such as flat packaged furniture, require customer assembly using small hardware items including screws, bolts, washers, nails, and wood pegs. These items are normally sealed in the same small plastic bag. The first challenge for the consumer is to identify the different parts. Next, the consumer must separate and organize these parts and insure each necessary piece is present. Finally, the consumer can assemble the item, while constantly being mindful not to disrupt the piles of organized hardware during assembly. Inexpensive, easy to produce multi-chamber packaging having selectively accessed chambers is desirable to consumers when purchasing sets of inexpensive goods sold as a single unit. A multi-chamber design eliminates sorting while selective accessibility to each chamber prevents jarring of the container from mixing the goods. Although these results are desirable, known methods of creating multi-chambered and selectively accessible packaging from more expensive plastic fabricating methods are not sufficiently cost effective for the packaging of inexpensive goods.

Consumers desire packaging for this class of goods that allows separation of the goods by type and that allows selective and independent access to each type of good. Consumers also desire packaging that can effectively store such goods as many times these goods are sold in bulk and intended for use over time or the goods include extra items that need to be stored after initial use, or the items can be misplaced during use if not organized. Such packaging could potentially sway a consumer between two competing brands, or raise the price threshold that a consumer is willing to pay.

Packaging intended to address many of these features has been produced using more expensive plastic forming methods. These expensive packaging solutions are as impractical for this class of inexpensive items. Some thermoforming solutions have been proposed, but each lacks feature(s) important to consumers. For instance, a single lid can be thermoformed to cover more than one chamber of a multi-chamber package. This solution provides packaging made using the less expensive thermoforming technique that can be used for storage after purchase. However, the lack of selective and independent access to each chamber is not provided. If a package is disrupted while a cover is open, all pieces of the package are at risk of falling out of their respective chambers, or of accidentally mixing with the items of other chambers making this solution unsatisfactory.

Accordingly, it would be desirable to provide inexpensive, easy to produce packaging, such as through thermoforming plastic having multiple chambers that can be selectively accessed.

SUMMARY OF THE INVENTION

The present invention is packaging having a plurality of chambers with each chamber selectively and independently covered by at least one flap. The packaging includes a base made of thermoformed plastic having a bottom, walls extending upward from the bottom and an opening. The packaging also includes a cover made of thermoformed plastic configured to cover at least a portion of the opening. The cover includes a plurality of flaps each covering a portion of the opening. One edge of each flap is defined by a hinge in the cover. At least one portion of the cover is connected to the base. The base and cover when connected define a plurality of chambers. Each flap is configured to provide access to a chamber independently of the other flaps, making each chamber selectively and independently accessible.

An object of the invention is to provide multi-chamber packaging made of thermoformed plastic where each chamber can be selectively and independently opened.

A further object of the invention is to provide multi-chamber packaging made of thermoplastic in a variety of shapes and sizes where each chamber can be selectively and independently opened.

BRIEF DESCRIPTION OF THE DRAWINGS

FIG. 5 is a top view of packaging having a circular cover.

FIG. 6 is a cross-sectional view taken along line 6—6 in FIG. 5.

FIG. 7 is a top view of pyramidal packaging.

FIG. 8*a* is a view of a rectangular packaging.

FIG. 8*b* is a view of a rectangular packaging.

FIG. 8*c* is a view of a square packaging.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
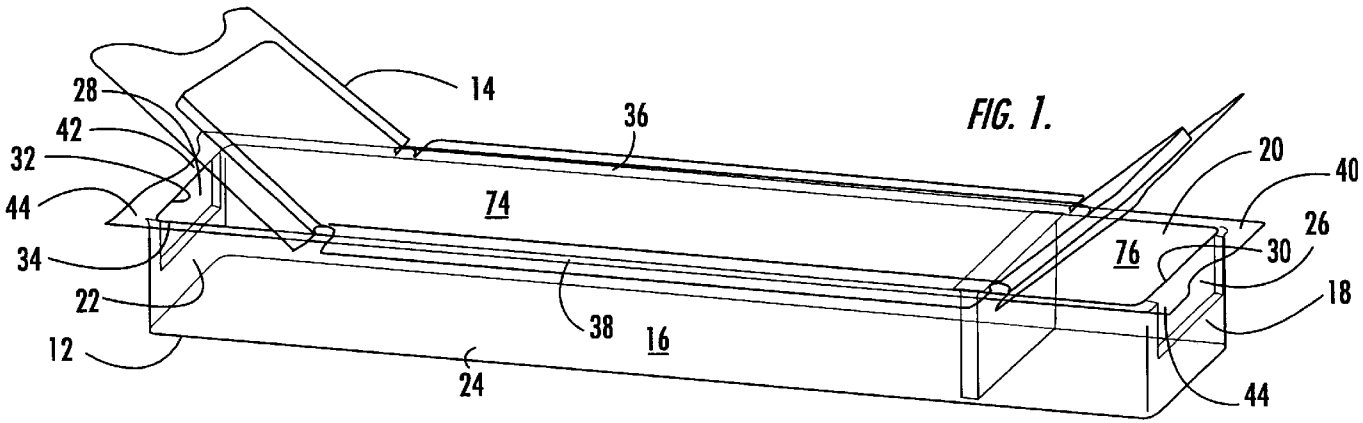
FIG. 1 is a perspective view of a unit of packaging.

Adverting to FIG. 1, an embodiment of the present invention is shown as packaging 10. Packaging 10 is designed for a replacement windshield wiper blade and its associated hardware and consists of a base 12 and a cover 14. Both base 12 and cover 14 are created through known methods of thermoforming sheets of plastic. Virtually any type of commercially available plastic can be used. Some examples include PVC, PET, PETG, HIPS, ABS and HDPE plastics. Here both base 12 and cover 14 are made of PVC that started at 0.015" thickness before thermoforming. The thickness of plastic used with packaging such as packaging 10 can range from approximately 0.0125" to 0.020". The thickness of thermoforming packages in general can range from 0.005" to 0.125" or heavier, and the present invention is useful to packaging within this entire range. Base 12 includes a bottom 16 and walls 18, 20, 22 and 24. The top of walls 18 and 22 end at steps 26 and 28 respectively. Step 26 is bounded by walls 18, 20, 24 and 30. Similarly, step 28 is bounded by walls 20, 22, 24, and 32. The top of walls 20, 24, 30 and 32 end at a raised surface 34 comprising rails 36 and 38 and plateaus 40 and 42. Surface 34 is surrounded by lip 44.

Figure 2:
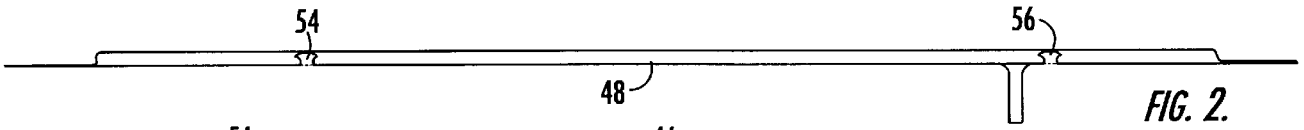
FIG. 2 is a side view of the cover to the packaging in FIG. 1.
Figure 3:
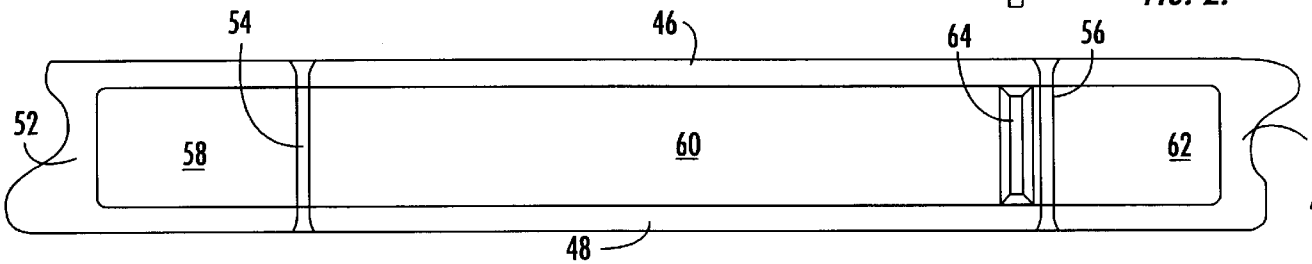
FIG. 3 is a top view of FIG. 2.

Cover 14, shown best in FIGS. 2 and 3, includes rails 46 and 48 as well as plateaus 50 and 52. Hinges 54 and 56 separate flaps 58, center sections 60 and flap 62. A divider wall 64 extends downward from the right marginal end of center section 60. The underside of rails 46 and 48 can be characterized as channels 66 and 68 respectively. Similarly, the underside of plateaus 50, 52 can be characterized as cavities 70 and 72.

Channels 66 and 68 are complementary with rails 36 and 38, respectively and cavities 70 and 72 are complementary with plateaus 40, 42, respectively. Rails 46 and 48 and plateaus 50 and 52 fit tightly into rails 36 and 38 and plateaus 40 and 42 forming friction fittings.

Figure 4:
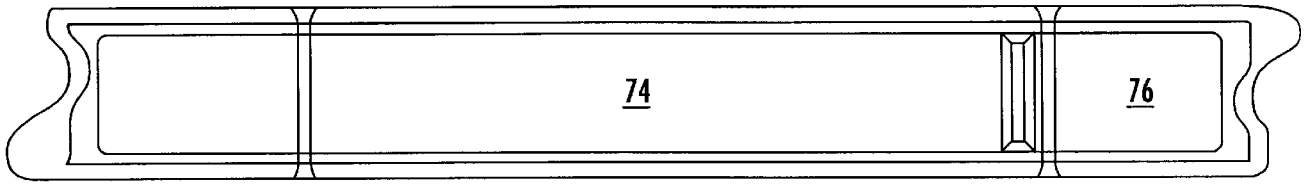
FIG. 4 is a top view of FIG. 1.
Figure 4A:
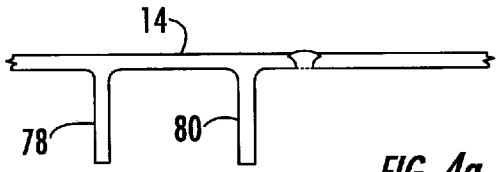
FIG. 4*a* is a side view of an alternative cover.
Figure 4B:
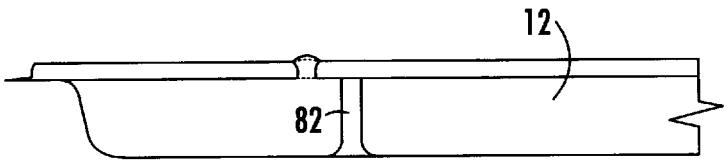
FIG. 4*b* is a side view of an alternative base.
Figure 4C:
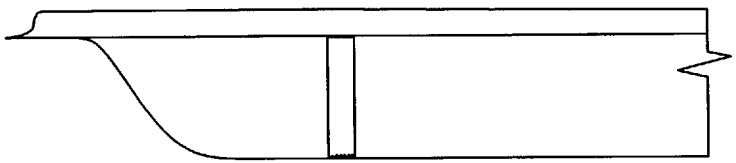
FIG. 4*c* is a side view of yet another alternative base.
Figure 4D:
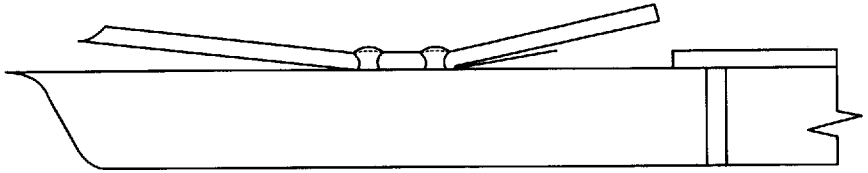
FIG. 4*d* is a side view of an alternative base and cover combination.
Figure 4E:
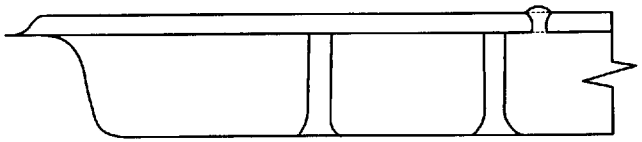
FIG. 4*e* is a side view of yet another alternative base and cover combination.

Hinges 54 and 56 are indentions that predispose cover 14 to bend at hinge 54 and 56. As such, flaps 58 and 62 act as "doors" into base 12. Divider wall 64 extends to bottom 16 when cover 14 is placed over base 12, effectively dividing base 12 into two separate and distinct chambers 74 and 76. Dividing walls can be incorporated into packaging 10 to make a plurality of chambers. For instance, cover 14 could have more than one dividing wall 78 and 80 (FIG. 4*a*), or a dividing wall 82 may be integral with base 12 (FIG. 4*b*), or a dividing wall may be originally independent of base 12 and cover 14 and then connected to either or both (FIG. 4*c*). Additionally, according to one aspect of the present invention, the base 12 and cover 14 can each include a dividing wall, such that the dividing walls are incorporated in the cover 14, as in FIG. 4*a,* and in the base 12, as in FIG. 4*b,* in one package. Furthermore, more than one flap could provide access to the same chamber (FIG. 4*d*) or a single flap could provide access to more than one chamber (FIG. 4*e*).

Adverting to FIG. 1, that portion of rails 46 and 48 between hinges 56 and 54 can be fixed connected or sealed to the corresponding length of rails 36 and 38 of base 12. An appropriate thermoplastic solvent can be used to "weld" these lengths together effective. Examples of solvents effective with PVC plastic are cyanoacrylate ester and 2-part epoxy bisphenol such as diglycidyl ester resin with a 2, 4, 6-triphenol curing agent. Applied Radio Frequency (RF) energy, heat sealing, and mechanical methods (e.g., snap locks, locking channels, rivets and staples) can achieve the same result. Cover 14 and base 12 may also connect using a simple friction fitting between rails 46, 48 and rails 36, 38 and plateaus 50, 52 and plateaus 40, 42.

Describing the operation of the invention during the installation of a replacement windshield wiper sold in packaging of the invention highlights its usefulness. Packaging 10 is specifically designed to hold a replacement windshield wiper blade in chamber 74 with its associated hardware held in chamber 76. A consumer selects packaging 10 from a store display after determining the replacement windshield wiper it holds meets the consumer's style, type and size requirements. When viewing the packaged windshield wiper blade in packaging 10, a consumer distinguishes between chambers 74 and 76 and easily determines both the windshield wiper blade and its necessary associated hardware are included in the package. During installation the consumer can set packaging 10 on a flat surface, such as the ground or the hood of the automobile. The consumer can selectively lift flap 58 to access chamber 74 allowing the consumer to remove the wiper blade without disturbing the contents of chamber 76. The consumer then selectively opens flap 62 to gain access to chamber 76 when a specific piece of hardware is needed during the installation process. The consumer is able to close flap 62 after removing the desired hardware to prevent the accidental disruption of package 10 spilling the hardware in chamber 76. When the wiper blade is completely installed and chamber 74 and 76 are both empty, the consumer has the option of disposing of packaging 10 or using it to store other items. Thus, the consumer's experience during the replacement of the wiper blade is enhanced and value is added by the resulting empty packaging 10 being available after installation of the wiper blade for other uses.

The invention is not limited to packages of a long, slender shape. For instance, FIG. 5 shows a container 100 having a circular cover 102 constructed in accord with the invention. Circular cover 102 mates with a substantially half-sphere base 104 including a hollow center post 106 having a pentagon cross-section comprising walls 108, 110, 112, 114 and 116, and five walls 118, 120, 122, 124, and 126 extending from the intersection of two center post walls, each ending at circumferential wall 128. A series of recesses, separately indicated at 130, exists at the midpoint of each section of circumferential wall 128 between each adjacent pair of walls 118, 120, 122, 124 and 126. Finally, hang tab 131 extends from circumferential wall 128 for easy display of the container 100. Any of the connecting methods discussed earlier can be used to connect cover 102 to center post 106. Center post 106 and cover 102 need not be flush with the top of circumferential wall 128 and instead form a cone-shaped cover 102 supported by center post 106.

Circular cover 102 includes a pentagon shaped cup 132 at its center that is complementary with center post 106 and five flaps 134, 136, 138, 140 and 142 each associated with a wall of cup 132 and corresponding to the area between each adjacent pair of walls 118, 120, 122, 124, and 126. FIG. 6 shows a cross-sectional view along line 6—6 in FIG. 5. Flap 142 includes a tray 146, a tray wall 148 surrounding tray 146 and a lip 150 extending from tray wall 148 on all sides but the side of tray 146 connecting to cup 132. The tray wall 148 fits snugly between walls 122, 124 and circumferential wall 128, creating a friction fitting to selectively retain flap 142 in its closed position.

Flaps 134–142 are formed through die cutting and can be selectively opened or closed as described earlier. Recesses 130 make it easier for each flap 134—142 to be opened. A cover substantially similar to cover 102 can be used with a variety of bases of different sizes and shapes. For example, FIG. 7 shows a triangular cover over a triangular cross-section post.

FIGS. 8(*a*)–(*c*) show yet another embodiment of the invention based on a rectangular or square base. FIG. 8(*a*) shows a rectangular base 200 having a cover 202 with three flaps, two large 204 and 206 and one small 208. Small flap 208 is a portion of large flap 206. FIG. 8(*c*) shows a square base 220 having four flaps 222, 224, 226 and 228. Flaps 222 and 224 rotate toward one another while flaps 226 and 228 rotate toward one another.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended clams. Although specific terms are employed herein, they are used in a generic and descriptive sense only and not for purposes of limitation.

That which is claimed:

1. Packaging for holding and displaying a windshield wiper and its associated hardware, comprising:

a generally rectangular base of thermoformed plastic configured to hold said windshield wiper and said hardware including a bottom, a plurality of vertical walls extending from the edges of said bottom, and an opening;

a generally rectangular cover configured to completely cover said base opening, said cover including two hinges, each proceeding between the two longer side edges of said cover, defining flaps;

said flaps separated by a center segment of said cover, said center segment connected to said base;

said cover also including a vertical wall extending vertically downward from said center segment defining two chambers in said base; and whereby each said flap selectively and independently can provide access to one of said chambers.

2. The packaging according to claim 1 wherein said plastic before thermoforming is PVC having a gauge of approximately 0.015".

3. Packaging for holding and displaying a windshield wiper and its associated hardware, comprising:

a generally rectangular base of thermoformed plastic configured to hold said windshield wiper and said hardware including a bottom, a plurality of vertical walls extending from the edges of said bottom, and an opening;

a generally rectangular cover configured to completely cover said base opening, said cover including two hinges, each proceeding between the two longer side edges of said cover, defining flaps that are separated by a center segment of said cover;

at least one vertical wall extending between the cover and the bottom, thereby defining two chambers in said base, wherein each flap selectively provides access to one of said chambers, and wherein the at least one vertical wall is fixedly attached to said cover.

4. Packaging for holding and displaying a windshield wiper and its associated hardware, comprising:

a generally rectangular base of thermoformed plastic configured to hold said windshield wiper and said hardware including a bottom, a plurality of vertical walls extending from the edges of said bottom, and an opening;

a generally rectangular cover configured to completely cover said base opening, said cover including two hinges, each proceeding between the two longer side edges of said cover, defining flaps that are separated by a center segment of said cover;

at least one vertical wall extending between the cover and the bottom, thereby defining two chambers in said base, wherein each flap selectively provides access to one of said chambers, and wherein at least one flap selectively provides access to the two chambers.

5. Packaging for holding and displaying a windshield wiper and its associated hardware, comprising:

a generally rectangular base of thermoformed plastic configured to hold said windshield wiper and said hardware including a bottom, a plurality of vertical walls extending from the edges of said bottom, and an opening;

a generally rectangular cover configured to completely cover said base opening, said cover including two hinges, each proceeding between the two longer side edges of said cover, defining flaps that are separated by a center segment of said cover, wherein each flap selectively provides access to the base opening, and wherein said cover includes a dividing wall extending into the opening and defining two chambers in said base.

* * * * *